United States Patent [19]

Bantien et al.

[11] Patent Number: 4,892,453

[45] Date of Patent: Jan. 9, 1990

[54] APPARATUS FOR MANIPULATING EMPTY AND FILLED TRAYS FOR CIGARETTES AND LIKE ROD-SHAPED ARTICLES BETWEEN MAKING AND PROCESSING MACHINES

[75] Inventors: Jürgen Bantien, Hamwarde; Dietrich Bardenhagen, Hamburg; Erich Staudte, Büchen, all of Fed. Rep. of Germany

[73] Assignee: Körber AG, Hamburg, Fed. Rep. of Germany

[21] Appl. No.: 71,189

[22] Filed: Jul. 8, 1987

[30] Foreign Application Priority Data

Jul. 17, 1986 [DE] Fed. Rep. of Germany ..... 3624133

[51] Int. Cl.[4] ..... A24C 5/352

[52] U.S. Cl. ..... 414/403; 414/274; 414/749; 414/733; 414/222; 414/661; 198/468.11; 198/739

[58] Field of Search ..... 414/273, 274, 331, 403, 414/404, 416, 749, 222, 733, 660, 661, 659; 198/468.1, 468.11, 739

[56] References Cited

U.S. PATENT DOCUMENTS

| | | | |
|---|---|---|---|
| 3,802,580 | 4/1974 | Castaldi | 414/274 |
| 4,299,533 | 11/1981 | Ohnaka | 414/733 X |
| 4,507,040 | 3/1985 | Baese et al. | 414/403 |
| 4,526,268 | 7/1985 | Hoffmann et al. | 414/63 X |
| 4,538,950 | 9/1985 | Shiomi et al. | 414/222 |
| 4,564,329 | 1/1986 | Bantien | 414/403 |
| 4,585,386 | 4/1986 | Gömann et al. | 414/403 |
| 4,626,160 | 12/1986 | Shiomi et al. | 414/222 |
| 4,668,152 | 5/1987 | Gömann et al. | 414/403 |
| 4,747,743 | 5/1988 | Dowding et al. | 414/403 |

FOREIGN PATENT DOCUMENTS 1757432 10/1971 Fed. Rep. of Germany .

*Primary Examiner*—Frank E. Werner
*Assistant Examiner*—Robert S. Katz
*Attorney, Agent, or Firm*—Peter K. Kontler

[57] ABSTRACT

Apparatus for distributing empty and filled trays in a production line wherein the output of a cigarette maker is normally processed by a packing machine has a tray filling unit which withdraws the surplus of cigarettes from the transporting unit between the maker and the packing machine, a tray evacuating unit which admits stored cigarettes from trays into the transporting unit when the requirements of the packing machine exceed the output of the maker, at least one mobile magazine for empty and filled trays, and a transferring device which can advance filled and empty trays directly between the two units or between either of the two units and the magazine. The transferring device has an inclined holder for a filled or an empty tray and motors which can move the holder up or down as well as about a vertical axis. A control circuit receives signals from suitably distributed detectors to store information pertaining to the distribution of empty and filled trays in the tray filling and evacuating units and in the magazine, as well as the locations of empty spots for trays in the magazine.

25 Claims, 10 Drawing Sheets

APPARATUS FOR MANIPULATING EMPTY AND FILLED TRAYS FOR CIGARETTES AND LIKE ROD-SHAPED ARTICLES BETWEEN MAKING AND PROCESSING MACHINES

BACKGROUND OF THE INVENTION

The invention relates to improvements in apparatus for transporting rod-shaped articles of the tobacco processing industry, and more particularly to improvements in apparatus for manipulating receptacles in the form of so-called chargers or trays which are used to temporarily store and transport arrays of parallel filter rod sections or plain filter cigarettes, cigars, cigarillos and like rod-shaped articles containing tobacco or being used in conjunction with tobacco-containing products. The invention will be described with reference to apparatus for the manipulation of receptacles for plain or filter cigarettes, but the apparatus can be used with equal or similar advantage to manipulate receptacles for temporary storage of other rod-shaped articles of the tobacco processing industry.

Modern production lines for cigarettes employ mass flow conveyors for direct transport of large quantities of cigarettes from a maker (such as a cigarette making machine or a filter tipping machine) to a processing machine (such as a packing machine or a reservoir). It is necessary to equip such production lines with buffer systems for temporary storage of excessive output of the maker when the output of the maker exceeds the requirements of the processing machine, and for admission of stored articles to the processing machine when the requirements of the processing machine exceed the output of the maker. A presently known and highly satisfactory buffer system employs an apparatus (hereinafter called filling unit) which has means for storing cigarettes in receptacles in the form of chargers or trays (hereinafter trays) and facilitates for temporary storage of empty and filled trays, and an apparatus (hereinafter called evacuating unit) which has means for discharging cigarettes from filled trays into the conveyor between the maker and the processing machine as well as facilities for temporary storage of filled and empty trays.

U.S. Pat. No. 4,564,329 to Bantien discloses an apparatus wherein a two-storey turret is employed as a means for transferring trays between the tray filling and tray evacuating units as well as between such units and a mobile magazine. The turret has two tray holders at each of the two levels but is incapable of moving trays between the levels. This necessitates such design of the magazine, tray filling unit and tray evacuating unit that all empty trays are transported at one of the two levels and all filled trays are transported at the other level. This detracts from the versatility of the apparatus, especially since it is desirable to keep empty trays at the upper level in the tray filling unit but at the lower level in the tray evacuating unit.

U.S. Pat. No. 4,585,386 to Gömann et al discloses a modified apparatus which can transport a mass flow of cigarettes directly from a maker to a processing machine and wherein the surplus of articles is stored in trays. The tray filling unit of this apparatus is directly coupled with the tray evacuating unit. Cigarettes which are discharged from trays in the tray evacuating unit are advanced by a mass flow conveyor along an arc of 180° to merge into the mass flow which is conveyed directly from the maker to the processing machine. In accordance with a modification, filled and empty trays are transported along a path which subtends an arc of 180° and connects the tray filling unit with the tray evacuating unit. The apparatus of Gömann et al. does not employ a mobile magazine and/or any means for transferring trays between such magazine and the tray filling and/or evacuating unit.

German Offenlegungsschrift No. 1,757,432 discloses an apparatus wherein each tray filling unit and each tray evacuating unit is associated with a discrete transfer device which can transfer empty or filled trays between the respective unit and a conveyor serving to circulate the trays along an endless path. Each tray filling unit delivers all filled trays to the conveyor which circulates the filled trays until a tray evacuating unit reports the need for filled trays whose contents are to be delivered to a particular processing machine. Filled trays which are supplied by several tray filling units circulate with empty trays which are supplied by several tray evacuating units. A drawback of this proposal is that a tray filling unit is likely to receive empty trays with a certain delay following the generation of a signal that the output of a maker exceeds the requirements of the associated processing machine, and that a tray evacuating unit is likely to receive filled trays with a certain delay because the conveyor cannot always maintain a filled tray in immediate proximity of the tray filling unit which is associated with a conveyor for delivery of cigarettes to a processing machine whose requirements then exceed the output of the corresponding maker. A delay in removal of the surplus which is turned out by a maker or a delay in admission of stored articles to a processing machine which cannot be adequately supplied by the corresponding maker can affect the operation of the production line, e.g., by necessitating a complete shutdown of a maker or of a processing machine with attendant huge losses in output and the production of rejects during deceleration and acceleration of the maker or the processing machine.

OBJECTS AND SUMMARY OF THE INVENTION

An object of the invention is to provide an apparatus which can manipulate receptacles for cigarettes and similar rod-shaped articles in such a way that the surplus which is turned out by a maker is stored practically without any delay and that the requirements of a production line which is incapable of receiving adequate quantities of articles from the associated maker can be immediately satisfied as long as is necessary to enable the maker to again meet the requirements of the processing machine.

Another object of the invention is to provide an apparatus whose versatility and flexibility greatly exceed those of the aforediscussed prior apparatus and which can manipulate conventional receptacles in the form of chargers or trays for cigarettes and similar rod-shaped articles of the tobacco processing industry.

A further object of the invention is to provide an apparatus which can treat the conveyed articles gently and whose operation can be automated to any desired extent.

An additional object of the invention is to provide the apparatus with novel and improved means for transferring receptacles between filling and evacuating units as well as between one or more stationary or mobile magazines and the filling and evacuating units.

Still another object of the invention is to provide the apparatus with novel and improved means for controlling the operation of the filling and evacuating units as well as the operation of the conveyor means for mobile magazines and of the means for transferring receptacles between the filling and evacuating units and/or between these units and the magazine or magazines.

A further object of the invention is to provide a novel and improved method of manipulating receptacles for plain or filter cigarettes or other rod-shaped articles of the tobacco processing industry.

The improved apparatus serves to manipulate receptacles for rod-shaped articles of the tobacco processing industry, particularly to manipulate so-called chargers or trays for plain or filter cigarettes and analogous rod-shaped articles. The apparatus comprises at least one first unit for filling of the receptacles with rod-shaped articles and at least one second unit for evacuating articles from filled receptacles. Each of these units comprises first and second facilities for temporary storage of empty and filled receptacles, and the apparatus further comprises at least one magazine for temporary storage of at least one receptacle outside of the first and/or second unit, and means for transferring receptacles directly between the first and second units as well as between the magazine and at least one of the units.

The apparatus preferably further comprises at least one transporting unit having means for conveying articles along a predetermined path wherein the articles preferably form a mass flow and advance substantially at right angles to their axes. The first unit has means for withdrawing articles from the path and for storing the withdrawn articles in empty receptacles, and the second unit has means for evacuating the contents of filled receptacles into the path. The receiving end of the path is connected with or adjacent the outlet of an article producing machine (such as a cigarette maker or a filter tipping machine), and the discharge end of the path is connected to or is adjacent the inlet of a processing machine (e.g., a cigarette packing machine).

In accordance with a presently preferred embodiment of the invention, the transferring means comprises a support (e.g., an upright column), a carriage which is mounted on the support for movement between a plurality of different levels and for angular movement between a plurality of different positions with reference to a substantially vertical axis, means for moving the carriage, and a holder for receptacles on the carriage. The aforementioned positions of the carriage and of the holder thereon preferably include at least one first position in which the holder can exchange receptacles with at least one of the aforementioned facilities (for example with one facility of the first unit or with one facility of the second unit), a second position in which the holder can exchange receptacles with at least one other facility (e.g., with the other facility of the first unit and with the other facility of the second unit), and at least one third position in which the holder can exchange receptacles with the magazine. The transferring means further comprises means for advancing receptacles between the holder on the one hand and the facilities and the magazine on the other hand. Such advancing means can comprise a first lever having a first portion which is pivotable with reference to the support about a fixed axis and a second portion, a second lever having a first portion articulately connected to the second portion of the first lever and a second portion provided with a pin, stud or other suitable means for entraining receptacles, means for pivoting the first lever with reference to the support, and means (such as a belt or chain transmission) for moving the second lever with reference to the first lever in response to pivoting of the first lever so that the entraining means preferably performs a movement along a substantially straight path. The support includes a bottom wall which is or can be inclined with reference to the aforementioned vertical axis so that the articles in a filled receptacle in the holder are inclined with reference to a horizontal plane, and the aforementioned straight path for the entraining means of the second lever is preferably parallel with the upper side of the bottom wall of the holder. The bottom wall constitutes or forms part of the means for supporting the receptacle in the holder of the transferring means in an inclined position. The apparatus can include means for changing the inclination of receptacles preparatory to or during transfer between the holder and the facilities of the first and second units.

The magazine is or can constitute a mobile magazine, e.g., a wheel-mounted wagon or a gondola which latter can advance along a suitable conveyor, preferably an overhead conveyor or a conveyor having an overhead portion in the region of the transferring means. If the mobile magazine is a floor-mounted conveyance (such as a wheel-mounted wagon), the apparatus further comprises means (such as a conveyor system with rails) defining a predetermined path for the conveyance (e.g., an endless path defined by a system of rails).

If the apparatus comprises a number of gondolas, each such gondola can be designed to provide room for at least one filled or empty receptacle. If the gondolas are arranged to travel overhead, at least in the region of the transferring means, the carriage on the support of the transferring means is mounted for movement to and from the level of gondolas above the support so that an empty gondola which is adjacent the transferring means can receive an empty or filled receptacle or that the holder can receive an empty or filled receptacle from the adjacent gondola.

The apparatus can include at least one additional first and second unit and additional means for transferring receptacles between the additional first and second units and the magazine or magazines. Such magazine or magazines are preferably movable along a predetermined path having portions adjacent each transferring means so that each transferring means can transfer filled or empty receptacles into, or can receive filled or empty receptacles from, a selected magazine.

The apparatus can further comprise control means for automatically or semiautomatically regulating the operation of the transferring means so as to ensure the presence of empty receptacles in the respective facility of the first unit and the presence of filled receptacles in the respective facility of the second unit. For example, the control means can comprise a processor which is connected with various detectors which are distributed in the apparatus adjacent the facilities of the first and second units and adjacent the magazine or magazines, a data storing memory which can be addressed to furnish information pertaining to the distribution of receptacles in the first and second units and in the magazine or magazines and the number and distribution of empty spaces in the magazine or magazines (such information is preferably updated whenever and as long as the apparatus is in use), and a program memory which is connected with and can be addressed by the processor to regulate the operation of the transferring means in accordance with a preselected program which is best suited to ensure proper distribution of empty and filled receptacles in or adjacent the first and second units.

The receptacles are or can be of the type having means for permitting or facilitating discrimination between filled and empty receptacles, and the apparatus then further comprises signal generating means for monitoring the presence of receptacles in the magazine, signal generating means for monitoring the discrimination facilitating means (e.g., openings) of receptacles in the magazine, and means for transmitting signals from the monitoring means to the control means so as to update the information which is stored in the first memory. The signals which are transmitted to the first memory can be stored in the form of a matrix, and the processor can be said to constitute a means for operating the transferring means in dependency upon the information which is stored in the form of a matrix. The control means can also generate signals which are used to effect movements of one or more magazines with reference to the transferring means so as to place an empty space into proper position for reception of an empty or filled receptacle or to place an empty or filled receptacle in the magazine in an optimum position for advancement into the holder of the transferring means or into the holder of one of several transferring means. The control means also receives signals which are transmitted by detectors adjacent the facilities of the first and second units to indicate the extent of occupancy of such facilities by filled or empty receptacles.

The processor of the control means is designed to update the information which is stored in the first memory on the basis of signals which are transmitted by various monitoring and detector means. The memory which contains the program for an optimum mode of operation of the apparatus is addressed by the processor, and the resulting signals are used to operate the transferring means and/or the drive or drives for the magazine or magazines.

The magazines can be provided with identifying indicia, and the apparatus then further comprises signal generating reader means which serves to read the indicia and to transmit signals to the control means. This is particularly desirable and advantageous if the apparatus comprises a plurality of magazines and a plurality of production lines each with its own maker, processing machine, means for transporting articles from the maker to the processing machine, a first unit, a second unit and a discrete transferring means. The control means then includes means for associating each magazine with a selected transferring means or for associating a particular magazine with a transferring means, depending on the requirements (empty and/or filled trays) of the respective production line. If the apparatus comprises several production lines, each with its own first and second units and transferring means, it can comprise a common control means which regulates the operation of all transferring means on the basis of information which is obtained as a result of monitoring all first and second units and all magazines. Such combined control means also comprises a memory for a matrix denoting the occupancy of all first and second units and all magazines as well as a processor which supplies information for such matrix and reads a predetermined program in order to ensure that all transferring means will operate in a predetermined manner so as to ensure an optimum utilization of all production lines and all components of each production line.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
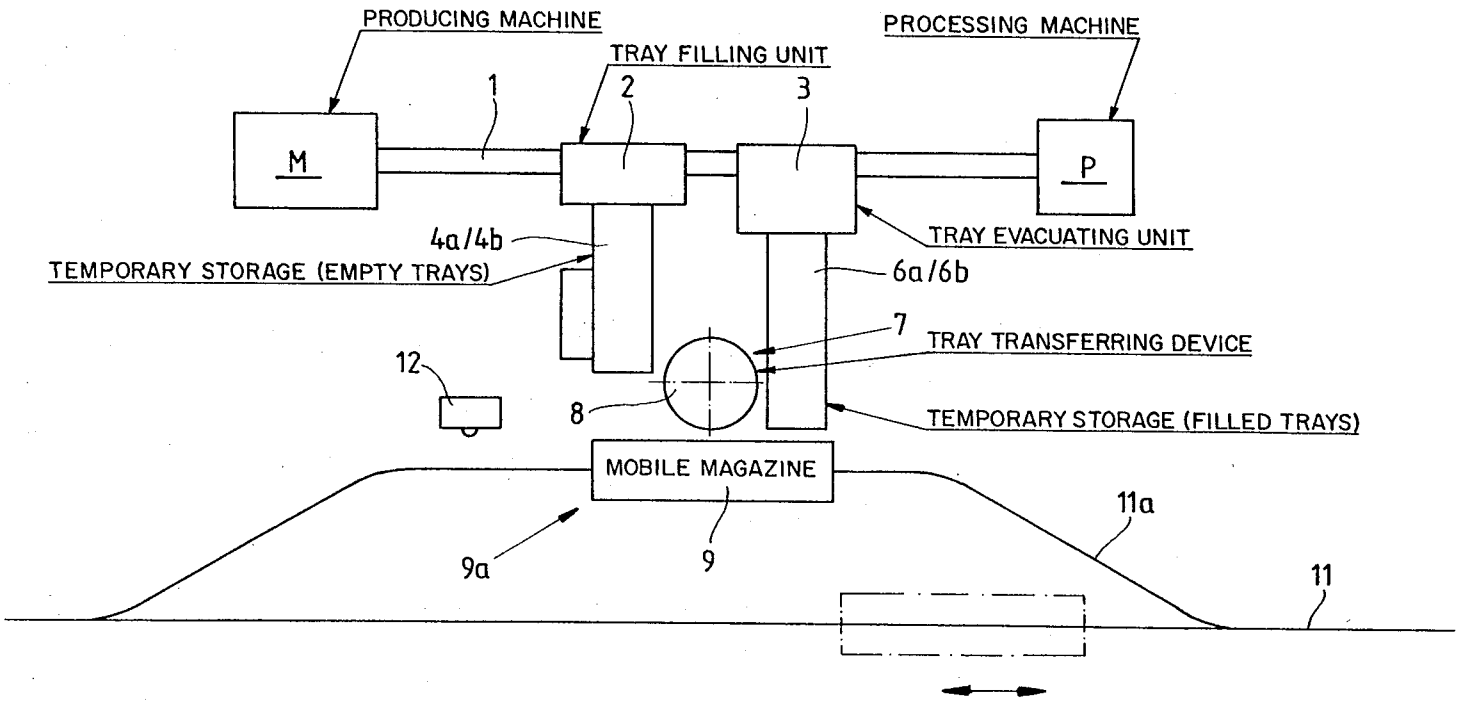
FIG. 1 is a schematic plan view of an apparatus which embodies one form of the invention and includes a single production line for plain or filter cigarettes.

The apparatus of FIG. 1 comprises a transporting unit 1 which can advance a mass flow of parallel plain or filter cigarettes from a producing machine M (such as a cigarette maker known as PROTOS or a filter tipping machine known as MAX or MAX S, both manufactured by the assignee of the present application) to a processing machine P (e.g., a packing machine of the type manufactured by the assignee of the present application). The apparatus further comprises a tray filling unit 2 (e.g., a mass flow tray filler of the type known as HFC manufactured by the assignee of the present application), and a tray evacuating unit 3 (e.g., a system known as MAGOMAT which is produced by the assignee of the present application).

The tray filling unit 2 has facilities 4*a* and 4*b* for temporary storage of empty and filled trays 13 (FIG. 2), respectively, and the facility 4*a* is located at a level above the facility 4*b*. Analogously, the tray evacuating unit 3 comprises a facility 6a for temporary storage of filled trays 13 and a facility 6b for temporary storage of empty trays. The facility 6a for filled trays is disposed at a level above the facility 6b for empty trays.

A transferring device 8 is located at a transfer station 7 and serves to exchange filled and empty trays 13 directly between the units 2, 3 as well as between either of these units on the one hand and a mobile magazine 9 on the other hand. The magazine 9 is located at a loading station 9a defined by a branch 11a of a conveyor system 11 which serves to advance the magazine 9 (and preferably one or more additional magazines 9) along an endless path or back and forth along a path of finite length. The branch 11a ensures that the illustrated magazine 9 does not interfere with the transport of one or more additional mobile magazines along the path which is defined by the main portion of the conveyor system 11.

FIG. 1 further shows monitoring means 12 which ascertains the number of empty and filled trays 13 in the magazine 9 and transmits appropriate signals to the control circuit 68 (FIG. 9) of the apparatus.

Figure 2:
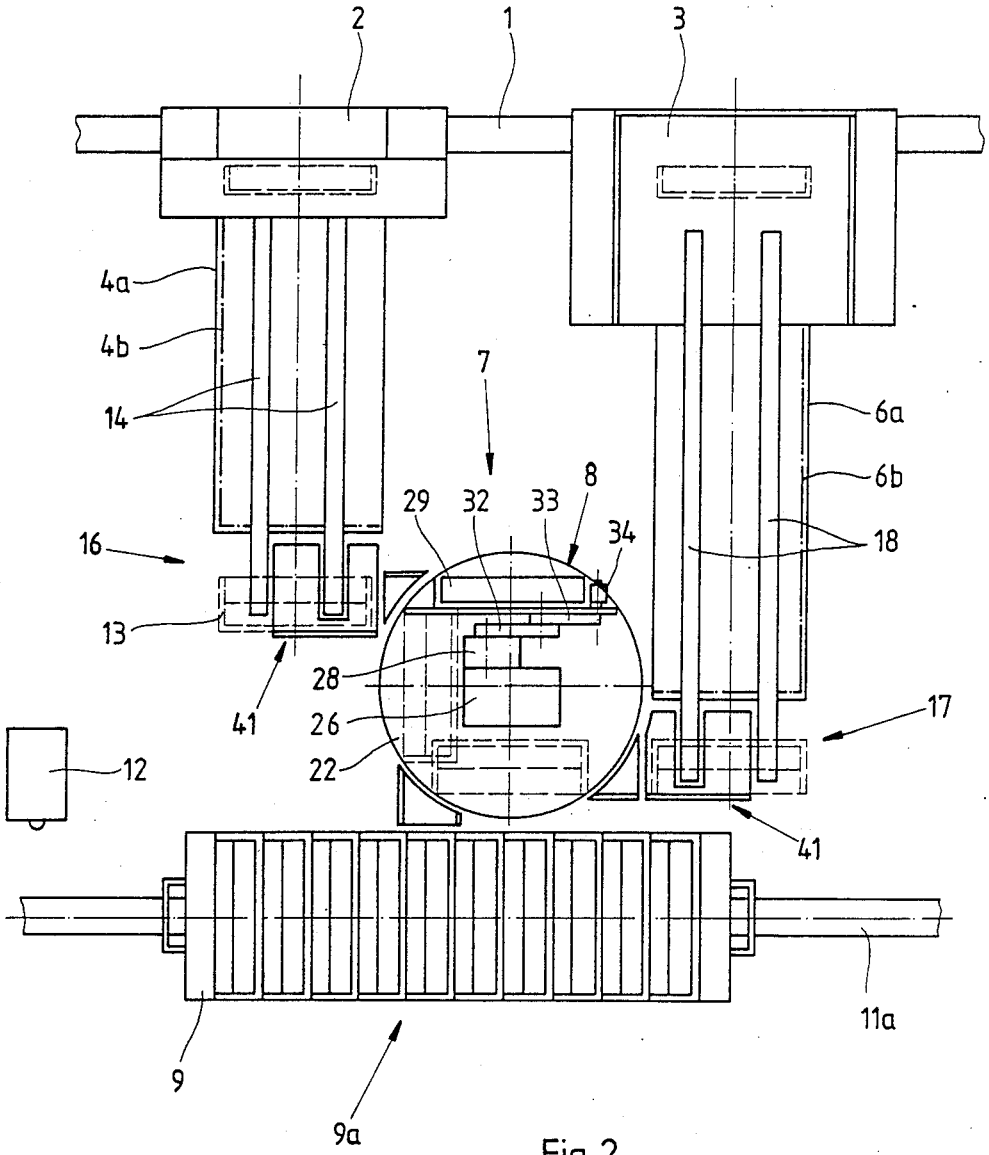
FIG. 2 is an enlarged plan view of a portion of the apparatus of FIG. 1 and shows certain details of the first and second units, of the transferring means and of the magazine.

FIG. 2 shows on a larger scale a portion of the apparatus of FIG. 1, namely the tray filling unit 2 with its tray storage facilities 4a, 4b, the tray evacuating unit 3 with its tray storage facilities 6a, 6b, the magazine 9 at the loading station 9a, the transferring device 8 at the station 7, and the monitoring means 12. In addition, FIG. 2 shows a first intersection or junction 16 which facilitates the advancement of empty or filled trays 13 from the facilities 4a, 4b to the transferring device 8 and vice versa, and a second intersection or junction 17 which facilitates the advancement of trays 13 between the device 8 and the facilities 6a , 6b of the unit 3.

The lower facility 4b (for temporary storage of filled trays 13) is shown in FIG. 2 by phantom lines, and the upper facility 4a for temporary storage of empty trays is shown by solid lines slightly out of vertical alignment with the facility 4b. In actual practice, the facilities 4a, 4b are or can be identical and normally exactly overlie each other.

The lower facility 6b of the unit 3 for temporary storage of empty trays 13 is shown by phantom lines slightly out of register with the upper facility 6a for temporary storage of filled trays 13. In actual practice, the facilities 6a and 6b are or can be identical and they normally accurately overlap each other.

Each of the facilities 4a, 4b has a pair of belt conveyors 14 or other suitable conveyor means for stepwise or continuous advancement of empty trays 13 (in 4a ) toward the tray filling station of the unit 2 and for stepwise or continuous advancement of trays 13 (in 4b) away from the tray filling station. Each of the facilities 6a, 6b has a pair of endless belt conveyors 18 or other suitable conveyors which serve to transport filled trays 13 (in 6a) toward the tray emptying or evacuating station of the unit 3 and to transport empty trays 13 (in 13b) away from the tray evacuating station, either stepwise or continuously. The facilities 4a, 4b can be identical, the same as the facilities 6a, 6b, and the facility 4a and/or 4b can be identical with the facility 6a and/or 6b.

That filled tray 13 in the facility 4b which is located at the intersection 16 is ready for transfer by the device 8 into the intersection 17 (preparatory to admission into the facility 6a) or for transfer by the device 8 into the magazine 9. Analogously, that empty tray 13 in the facility 6b which is located at the intersection 17 is ready for transfer by the device 8 to the intersection 16 (for delivery to the facility 4a) or for transfer to the magazine 9.

The illustrated intersection 16 is formed by the extensions of pairs of belt conveyors 14 in the facilities 4a, 4b so that an empty tray 13 can be deposited on the upper belt conveyors 14 for entry into the facility 4a proper, and that a filled tray 13 on the lower belt conveyors 14 can be readily engaged and advanced onto the transferring device 8. The construction of the intersection 17 is analogous except that it is formed by the extensions of the upper and lower belt conveyors 18.

Figure 3:
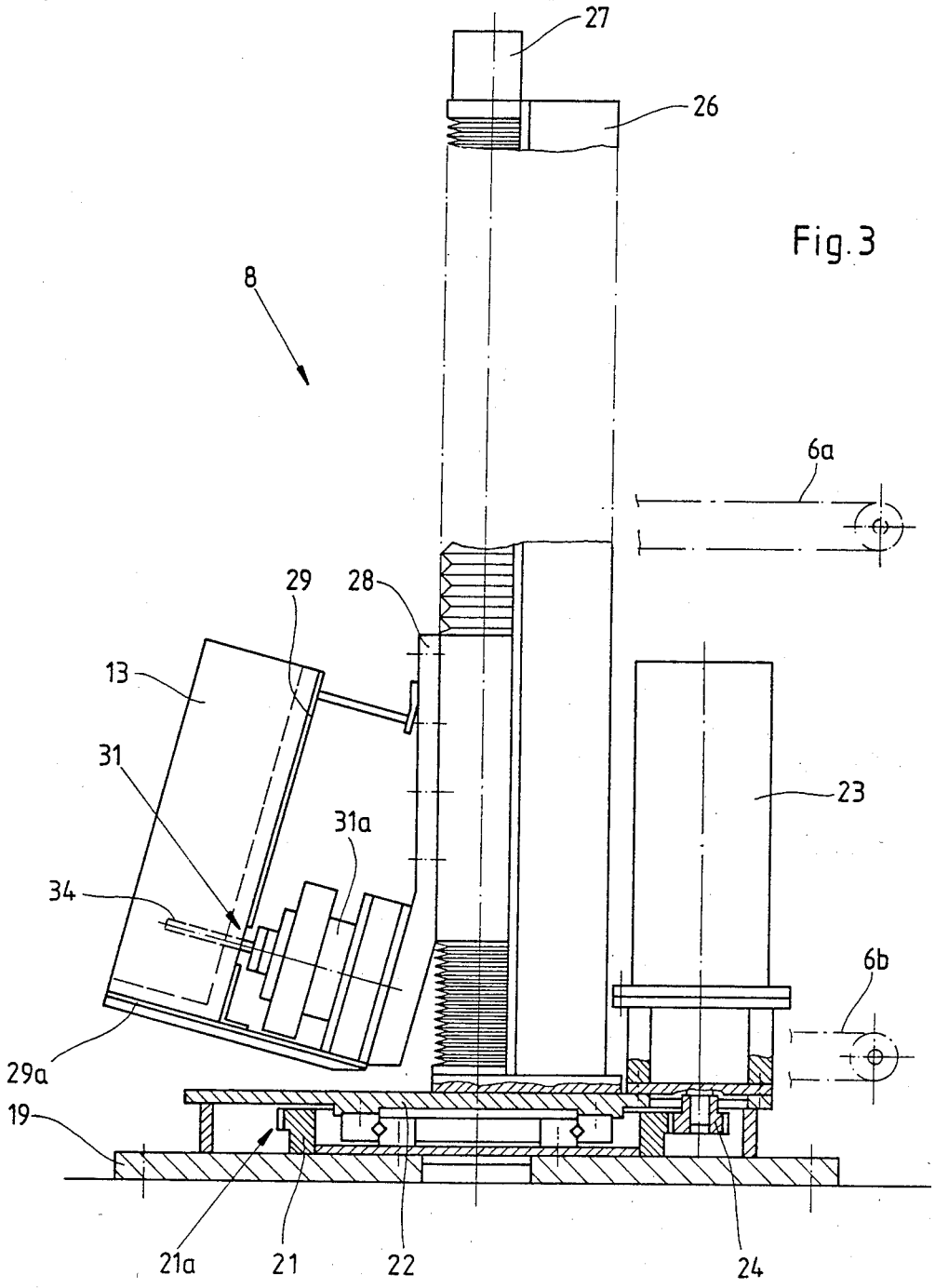
FIG. 3 is an enlarged side elevational view of the transferring means, with certain parts broken away and with certain parts shown in a vertical sectional view.

Certain details of the transferring device 8 are shown in FIGS. 2 and 3. This device comprises a base or bed 19 for a fixedly mounted ring gear 21 having an annulus of external teeth 21a and being overlapped by a turntable 22 which is rotatably mounted on the base 19 and carries a support 26 in the form of an upright column 26. The means for rotating the turntable 22 and the column 26 about a vertical axis comprises a motor 23 which is mounted on the platform 22 and drives a pinion 24 in mesh with the fixedly mounted gear 21. Thus, when the motor 23 is on (in a clockwise or counterclockwise direction), the pinion 24 rolls along the teeth 21a of the gear 21 and causes the turntable 22 and the column 26 to turn about the vertical axis.

The column 26 supports a carriage 28 which is movable up and down by a motor 27 and is provided with a substantially L-shaped holder or container 29 designed to accommodate one tray 13 at a time. However, it is equally within the purview of the invention to provide the holder 29 with spaces for simultaneous reception and retention of two or more trays 13. The holder 29 is inclined so that a tray 13 on its bottom wall 29a is tilted (the upper portion of the tray 13 in the holder 29 is nearer to the column 26 than the lower portion of such tray) in order to prevent escape of cigarettes which are confined in the tray and which would be likely to fall out through the open front side of the tray if the tray were held in upright position. The inclination of the tray 13 in the holder 29 suffices to ensure that all cigarettes of the array of cigarettes in the tray tend to slide rearwardly and to abut the inner side of the rear panel of the tray.

Figure 4:
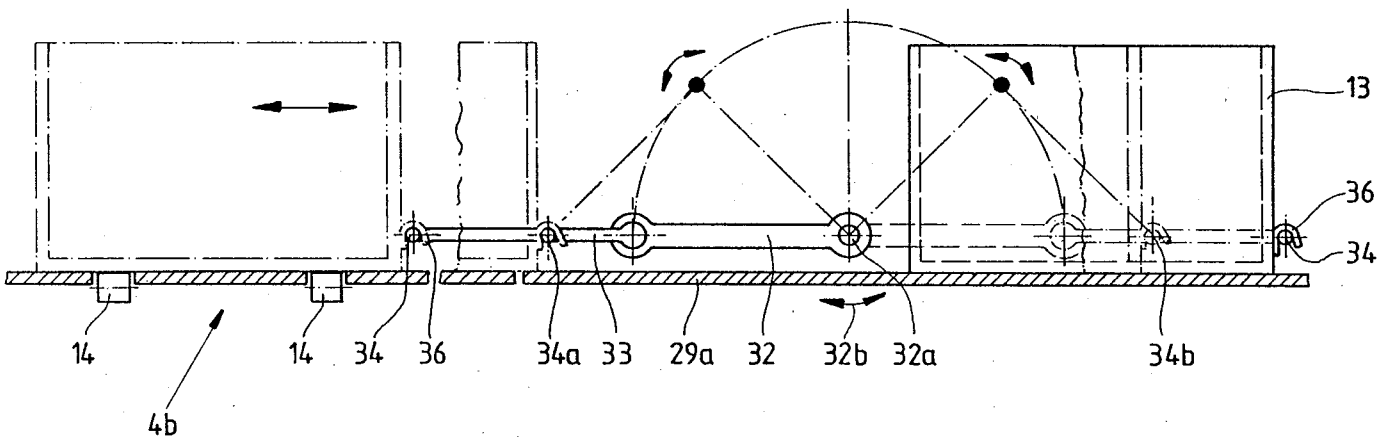
FIG. 4 is an enlarged partly elevational and partly vertical sectional view of the holder in the transferring means, of a portion of the first unit, and of the means for advancing receptacles between the holder and the first unit.
Figure 5:
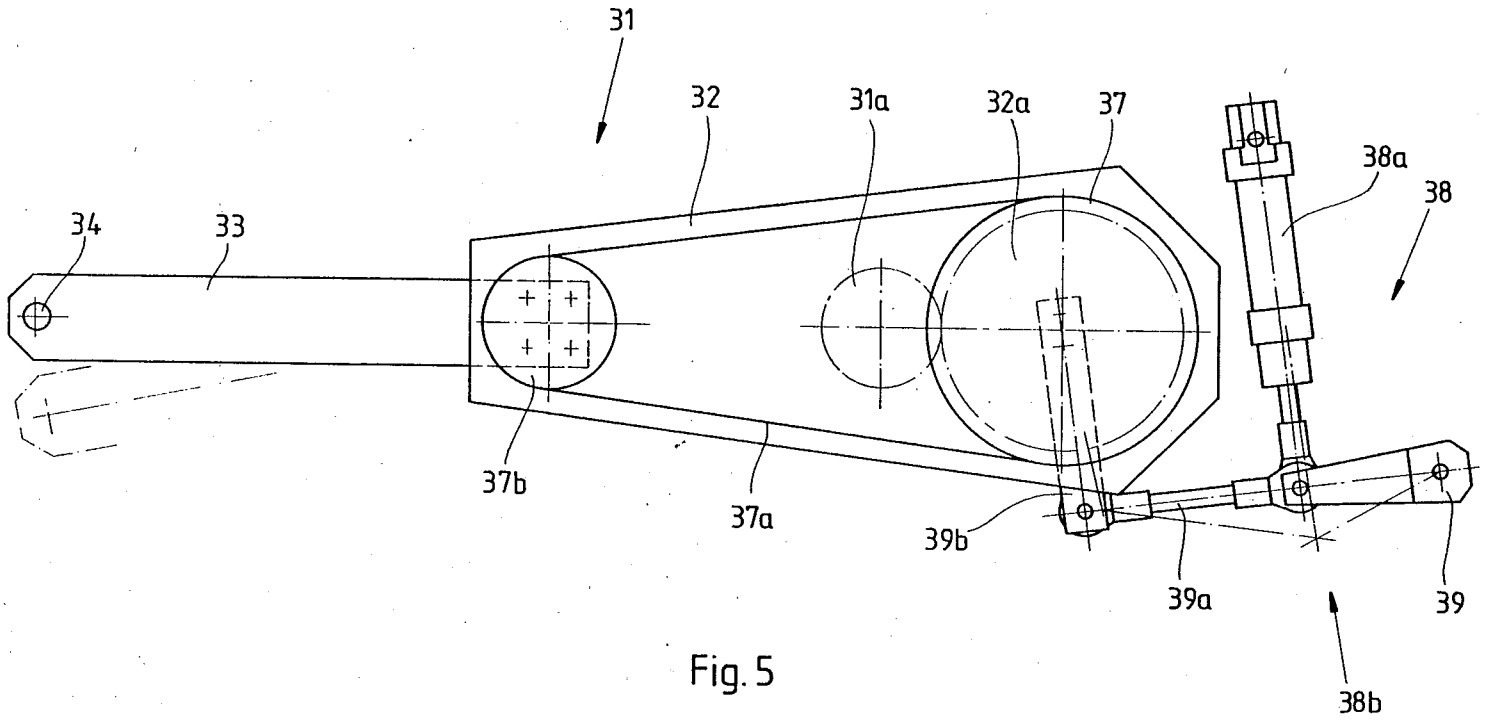
FIG. 5 is an enlarged plan view of the advancing means of FIG. 4.
Figure 6:
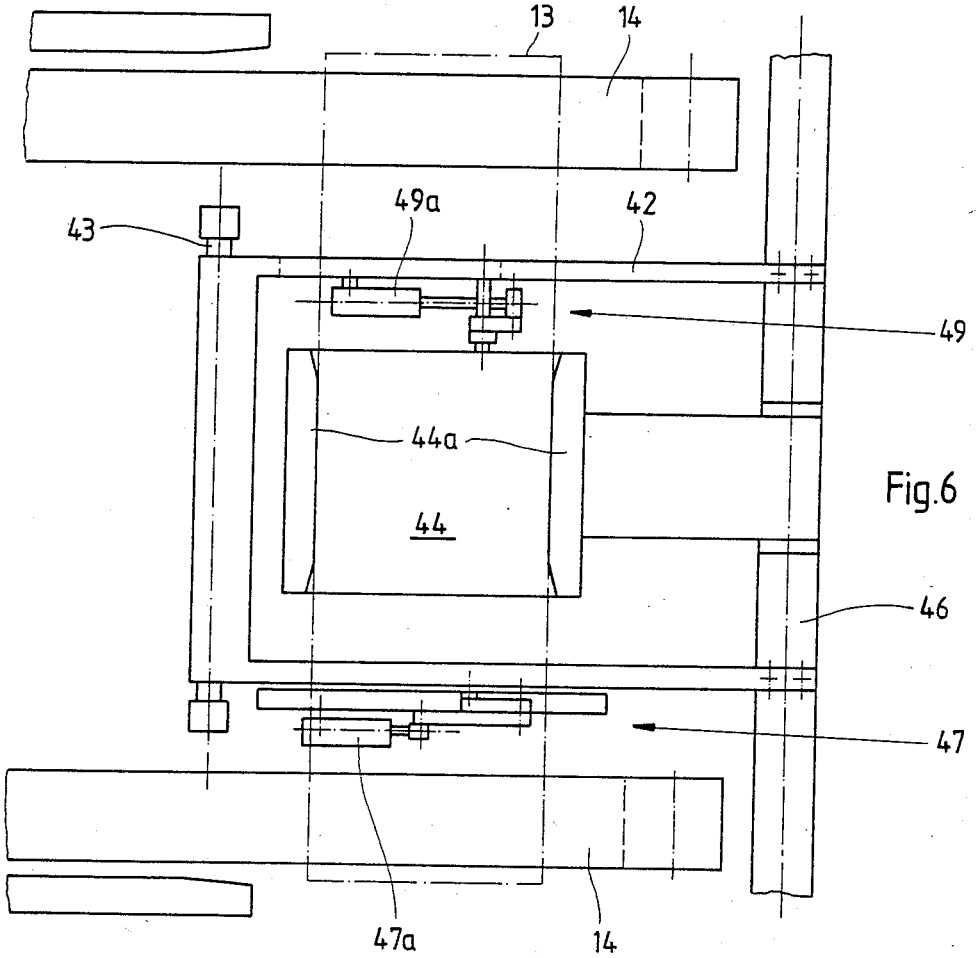
FIG. 6 is a plan view of a mechanism for tilting receptacles prior to or during advancement into the magazine or into one of the units, or prior to advancement of a receptacle into the holder.

A filled tray 13 which is temporarily stored in the facility 4b of the tray filling unit 2 at the intersection 16 must be pulled through the intersection and into the holder 29 of the carriage 28 on the column 26 of the transferring device 8. The transferring device 8 has means for advancing trays 13 from the facility 4b, through the intersection 16 and into the holder 29, and such advancing means comprises a lever mechanism 31 which is shown in FIGS. 4 and 5. The mechanism 31 comprises a first lever 32 one end portion of which is pivotable about the axis of a fixed driver shaft 32a receiving motion from a motor 31a (FIG. 3) behind the holder 29 on the carriage 28. The shaft 32a is parallel to the upper side of the inclined bottom wall 29a of the holder 29. The free end portion of the lever 32 is articulately connected with one end portion of a second lever or link 33 the other end portion of which carries an entraining pin 34 which can enter a suitably configurated inverted U-shaped yoke or socket 36 on the tray 13. For the sake of simplicity and clarity, FIG. 4 merely shows the facility 4b of the tray filling unit 2 with the belt conveyors 14 for filled trays 13 and the bottom wall 29a of the holder 29 on the carriage 28 of the transferring device 8.

The motor 31*a* can pivot the lever 31 back and forth along an arc of 180° (arrow 32*b*). The lever 31 is rigidly connected with a toothed pulley 37 which is coaxial with the shaft 32*a*. A second toothed pulley 37*b* is fixedly connected with the lever 33 and is coaxial with the pivot member between the levers 32, 33. A toothed belt 37*a* is trained over the pulleys 37, 37*b* to ensure that the entraining pin 34 on the free end portion of the lever 33 travels along a straight path in parallelism with the exposed surface of the bottom wall 29*a* of the holder 29 when the lever 32 is pivoted by the motor 31*a*. If the lever 32 is pivoted in a clockwise direction from the solid-line position of FIG. 4, it moves the pivot member which connects its free end portion with the lever 33 along an arcuate path which is denoted by a phantom line and the entraining pin 34 moves from the left-hand solid-line position to the first intermediate position 34*a*, thereupon to the second intermediate position 34*b* and ultimately to the right-hand solid-line position of FIG. 4. This results in an advancement of the tray 13 from the phantom-line left-hand position on the belt conveyors 14 of the facility 4*b* onto the bottom wall 29*a* of the holder 29 on the carriage 28 of the transferring device 8.

In order to enable the entraining pin 34 of the lever 33 to move beneath and to thereupon enter the adjacent yoke or socket 36 of the tray 13 from below, it is necessary to incline the lever 33 slightly in a counterclockwise direction below the solid-line position of FIG. 4 and to thereupon incline the lever 33 in a clockwise direction to the solid-line position of FIG. 4. Such inclining operation is carried out by a toggle mechanism 38 which is shown in FIG. 5 and includes a first lever or link 39 pivotable on the carriage 28 or on the holder 29 about a fixed horizontal axis in response to actuation of a reversible motor 38*a* in the form of a double-acting hydraulic or pneumatic cylinder and piston unit. The piston rod of the motor 38*a* is connected to the pivot pin between the free end portion of the lever 39 and a second lever 39*a* which is articulately connected to a lever 39*b*. The latter is rigid with the driver shaft 32*a* and lever 32. When the linkage including the levers 39, 39*a* of the toggle mechanism 38 is moved from the solid-line position to the phantom-line position 38*b* of FIG. 5 (in response to such actuation of the motor 38*a* that its piston rod is moved downwardly, as seen in FIG. 5), the lever 39*b* is pivoted in a counterclockwise direction and causes the pulley 37 to move the belt 37*a* which, in turn, causes the pulley 37*b* to move the lever 33 from the solid-line position to the phantomline position of FIG. 5. The entraining pin 34 is then located at a level below the socket or yoke 36 of the adjacent tray 13 and can enter such socket from below in response to renewed actuation of the motor 38*a* in order to return the linkage 39, 39*a* from the phantom line position 38*b* to the solid-line position of FIG. 5. The lever 33 is then properly coupled to the tray 13 and can advance such tray from the conveyors 14 in the facility 4*b* of the tray filling unit 2 into the holder 29 of the transferring device 8.

When the transfer of a tray 13 into the holder 29 is completed, the holder 29 is caused to turn about the vertical axis of the column 26 in response to actuation of the motor 23 and/or is caused to move vertically along the column 26 in response to actuation of the motor 27 so as to change the angular position and/or the level of the tray until the tray is ready for transfer into the magazine 9 or into the facility 6*a* of the tray evacuating unit 3.

Figure 7A:
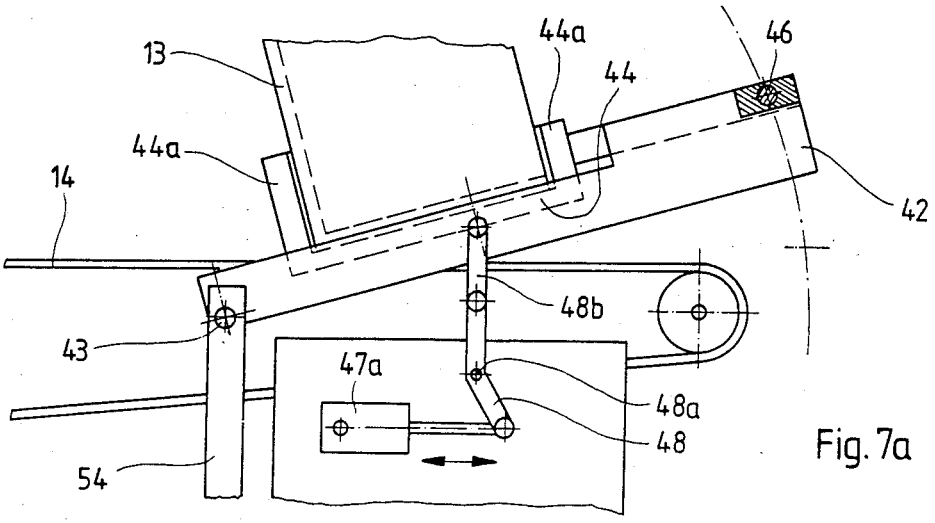
FIG. 7*a* is a side elevational view of the tilting mechanism in one of its positions.
Figure 7B:
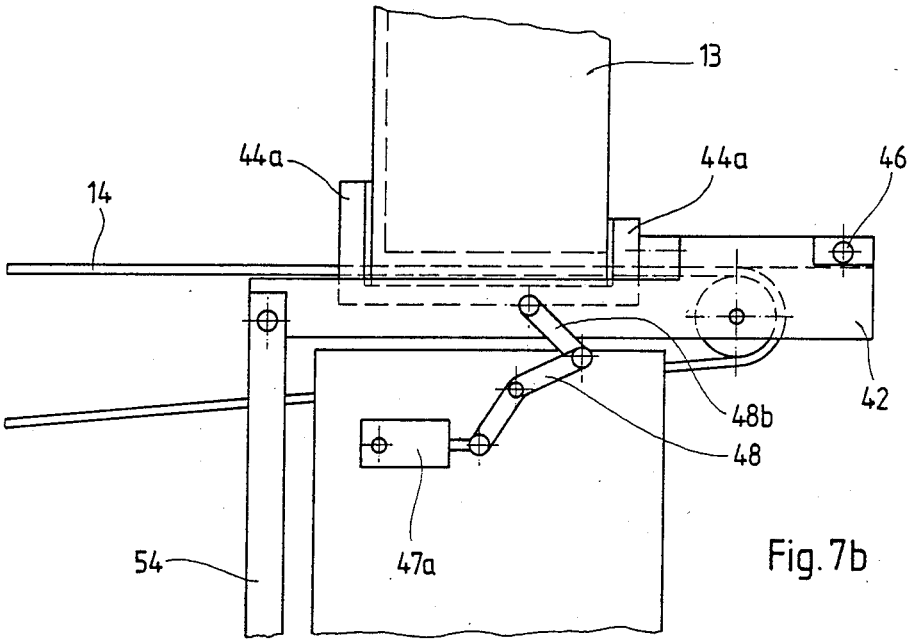
FIG. 7*b* is a similar side elevational view of the tilting mechanism in a second position.
Figure 7C:
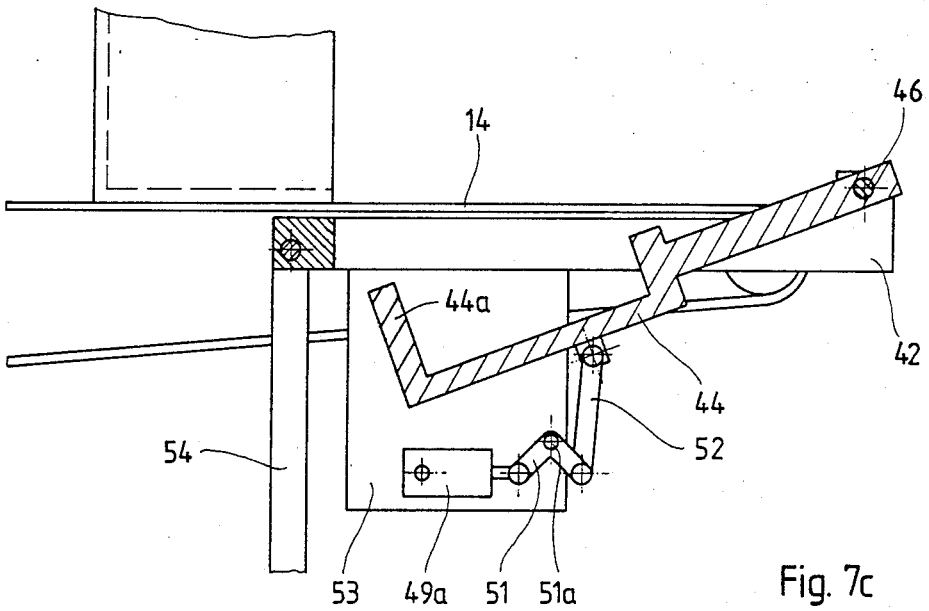
FIG. 7*c* is a side elevational view of the tilting mechanism in a third position.

The means for changing the inclination of trays 13 prior to transfer onto the holder 29 on the carriage 28 or subsequent to removal from the holder 29 includes tilting or inclination changing devices 41 which are provided at the intersections 16 and 17. The details of one of these inclination changing devices 41 are shown in FIGS. 6, 7*a*, 7*b* and 7*c*. All of the devices 41 are identical, the illustrated device 41 comprises a pivotable frame 42 which is mounted for pivotal movement about the axis of a shaft 43 which is installed in the frame or housing 54 of the apparatus. That portion of the frame 42 which is remote from the shaft 43 carries a shaft 46 for a tiltable platform 44 having two spaced-apart upstanding parallel guide rails 44*a* for a tray 13. The means for changing the inclination of the frame 42 comprises a lever mechanism 47 which includes a hydraulic or pneumatic motor 47*a* in the form of a double-acting cylinder and piston unit. The lever mechanism 47 includes a bell crank lever 48 (see particularly FIGS. 7*a* and 7*b* ) which can pivot about the axis of a stationary pivot member 48*a* and is articulately connected with a second lever or link 48*b* which is further articulately connected with the frame 42. In FIG. 7*a*, the piston rod of the motor 47*a* maintains the bell crank lever 48 in an angular position in which the link 48*b* holds the frame 42 in an inclined position such that the shaft 46 (which is parallel with the shaft 43) is located at a level well above the shaft 43. If the piston rod is retracted into the cylinder of the motor 47*a*, the bell crank lever 48*a* is caused to assume the position of FIG. 7*b* in which the frame 42 is substantially or exactly horizontal. If the tray 13 which is supported by the platform 44 in the upright position of FIG. 7*b* is to be disengaged from the platform 44 and from its guide rails 44*a*, the platform 44 is pivoted relative to the frame 42 (about the axis of the shaft 46) to the downwardly inclined position of FIG. 7*c* in which the guide rails 44*a* are located at a level beneath the belt conveyors 14 of the facility 4*a* or 4*b* so that the conveyors 14 can be set in motion in order to advance the tray 13 (which is held in upright position because it rests on the horizontal upper reaches of the conveyors 14) away from the intersection 16.

The means for changing the inclination of the platform 44 with reference to the tiltable frame 42 comprises a second lever mechanism 49 which is operated by a motor 49*a* in the form of a doubleacting hydraulic or pneumatic cylinder and piston unit mounted on a supporting wall 53 fixed to the frame 42. The piston rod of the motor 49*a* is connected with one arm of a bell crank lever 51 which is pivotable about the axis of a horizontal pivot member 51*a* on the wall 53 and is articulately connected to a second lever or link 52 which is further articulately connected to the platform 44. The shaft 43 for the frame 42 is mounted in the frame or housing 54 of the apparatus.

The frame 42 and its platform 44 are used to change the inclination of inclined trays 13 or the inclination of upright trays, depending upon whether a tray is to be transferred from the holder 29 onto a pair of conveyors 14 or 18, or from a pair of these conveyors onto the bottom wall 29*a* of the holder 29. For example, if a filled tray 13 is to be removed from the holder 29 on the carriage 28 of the transferring device 8 for deposition on the conveyors 18 of the facility 6*a* (for filled trays) of the tray evacuating unit 3, the mechanisms 47 and 49 are actuated to respectively move the frame 42 and the platform 44 to the inclined positions of FIG. 7*a*. The inclination of the platform 44 then equals or closely approximates the inclination of the bottom wall 29a of the holder 29. In the next step, the lever mechanism 31 of the transferring device 8 is actuated to advance the filled tray 13 from the holder 29 onto the platform 44 so that the tray is located between the guide rails 44a. When the tray 13 is properly located on the platform 44, the frame 42 is tilted from the position of FIG. 7a to the position of FIG. 7b whereby the bottom panel of the tray 13 between the guide rails 44a comes to rest on the upper reaches of conveyors 18 in the tray storage facility 6a of the tray evacuating unit 3. At such time, the tray 13 is already maintained in an upright position (note the inclination of the platform 44 in FIG. 7b). In the next step, the lever mechanism 49 is actuated by the motor 49a in order to move the platform 44 with reference to the frame 42 to the inclined position of FIG. 7c in which the guide rails 44a do not interfere with advancement of the tray 13 in response to starting of the motor which drives the conveyors 18. This results in advancement of the tray 13 (in upright position) from the intersection 17 into the facility 6a of the unit 3.

The operation is similar if a tray 13 is to be transferred from the facility 4b or 6b onto the bottom wall 29a of the holder 29. The sequence of movements of the frame 42 and platform 44 is somewhat different because the orientation of the tray must be changed from upright to inclined.

Figure 8:
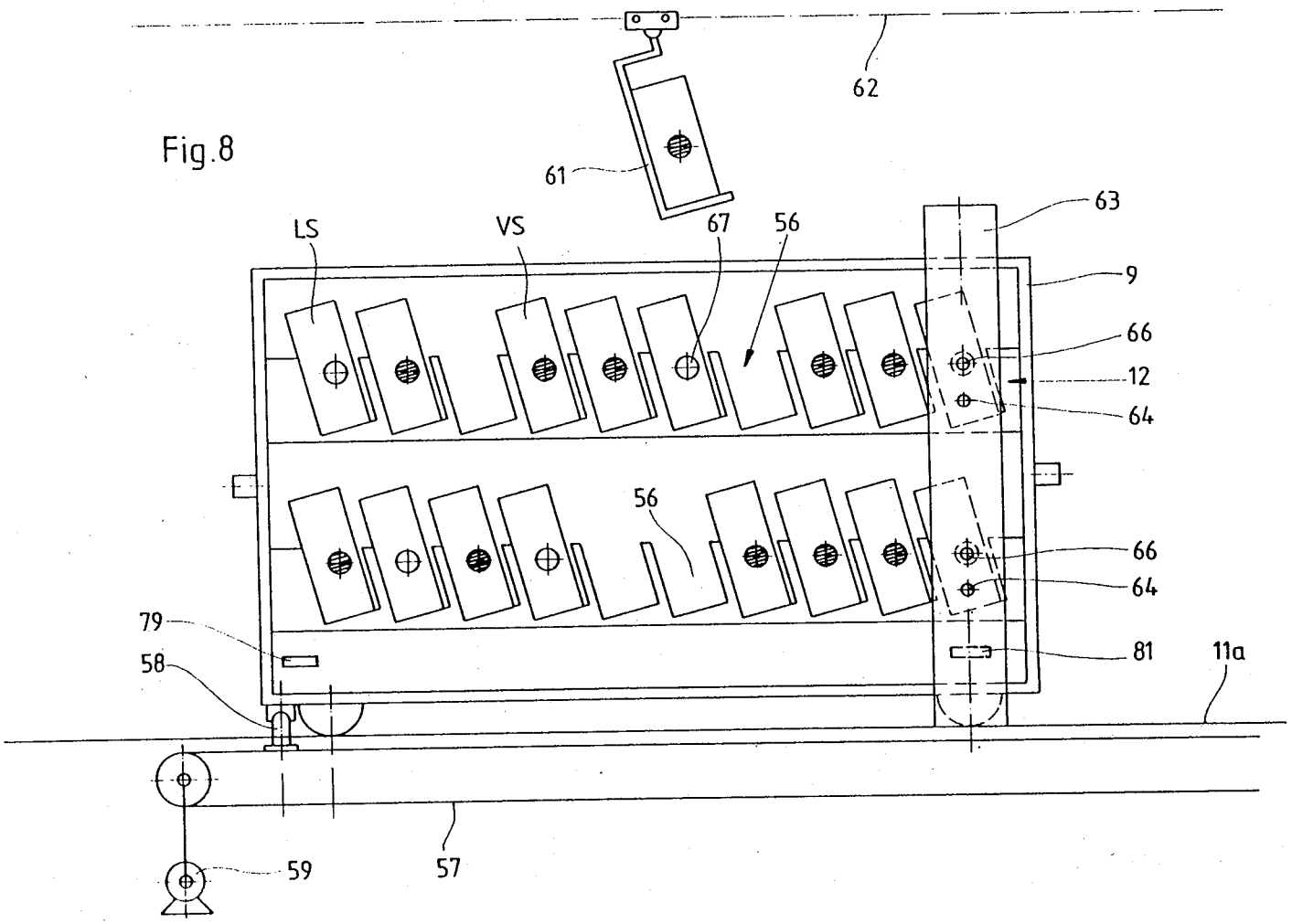
FIG. 8 is an enlarged elevational view of a floor-mounted magazine and of a magazine in the form of a gondola on an overhead conveyor.

FIG. 8 is an elevational view of the magazine 9 which is a mobile conveyance in the form of a wagon or van which is adapted to store empty and filled trays 13 at two levels. The upper storey of the magazine 9 has a first row of inclined holding means in the form of pockets 56 for empty or filled trays (filled trays are shown at VS and empty trays are shown at LS), and the lower storey of the magazine 9 has a second row of inclined pockets 56 for similarly inclined empty and filled trays. The magazine 9 is or can be provided with wheels and is advanced by the pushers 58 of a chain conveyor 57 which is driven by a motor 59. The conveyor 57 has a portion extending along the branch 11a of the conveyor system 11 which latter defines an endless path or a path of finite length. As mentioned above, the loading station 9a where the magazine 9 comes to rest for reception of trays 13 from the transferring device 8 or for advancement of trays from its pockets 56 to the transferring device 8 is preferably spaced apart from the main track for several magazines 9 so that the magazine of FIG. 8 cannot interfere with transport of other magazines to additional loading stations (such as the stations 9b and 9c shown in FIG. 10).

The magazine 9 can be replaced with other types of magazines, e.g., by a set of gondolas 61 one of which is shown in FIG. 8 at a level above the magazine 9 and is suspended from an overhead conveyor 62. If the apparatus of the present invention employs magazines in the form of gondolas 61, the carriage 28 on the column 26 of the transferring device 8 is movable between three different levels, namely those of the facilities 4b, 6b, of the facilities 4a, 6a and of the gondolas 61 on the overhead conveyor 62. If the apparatus employs only floor-mounted magazines 9, the carriage 28 must be mounted for movement between two levels, namely that of the upper storey of the magazine 9 (which is or can be the same as the level of the facilities 4a and 6a) and that of the lower storey of the magazine 9 (which is or can be the same as that of the facilities 4b and 6b).

Figure 9:
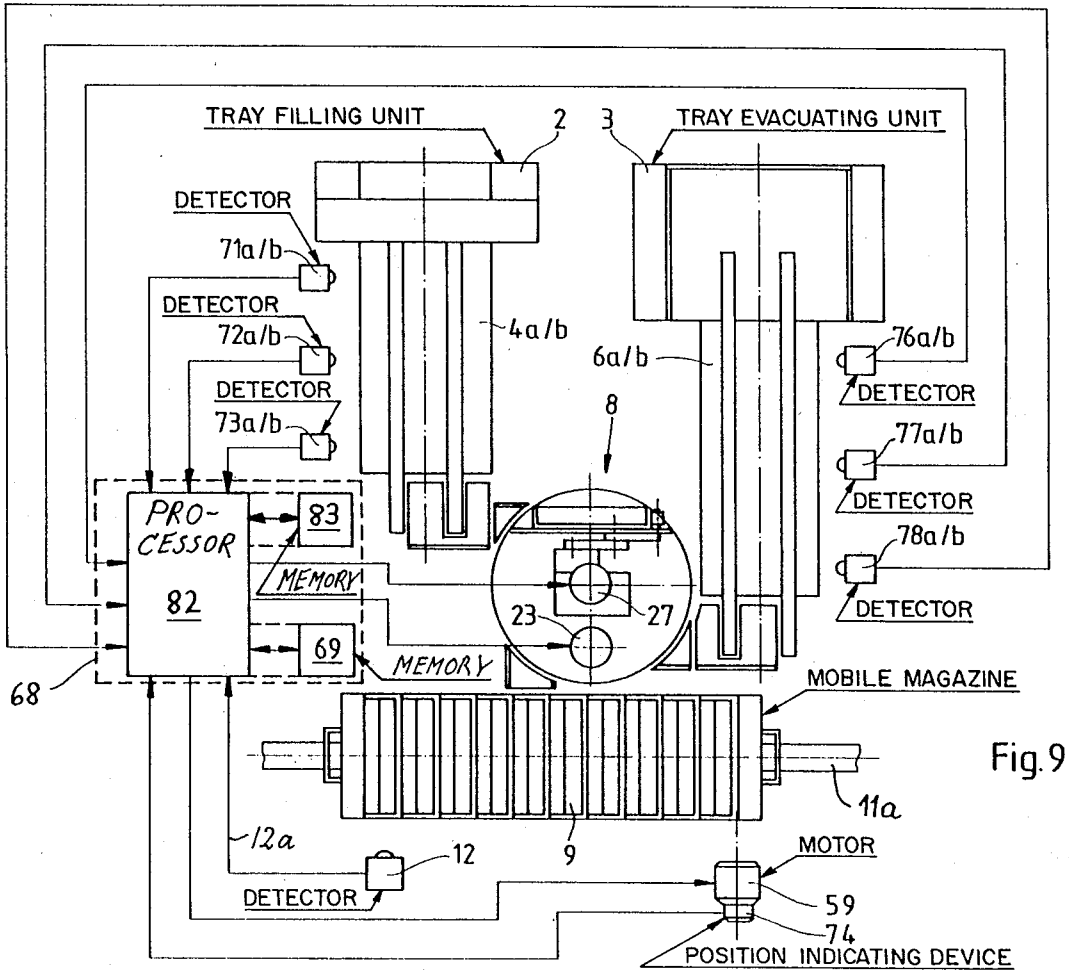
FIG. 9 is a plan view similar to that of FIG. 2, further showing the control circuit which regulates the operation of the transferring means.

A post 63 which is installed at the loading station 9a supports the monitoring means 12. This monitoring means includes means for monitoring the occupancy of the magazine 9, i.e., for ascertaining the number of positions of empty and filled pockets 56. Signals which are generated by the detectors of the monitoring means 12 are transmitted to the control circuit 68 which is shown in FIG. 9. The monitoring means 12 comprises a reflection type optoelectronic detector 64 for each of the two storeys of the magazine 9; these detectors ascertain whether or not the pockets 56 are occupied. Additional photoelectronic detectors 66 at the levels of the two storeys of the magazine 9 are used to ascertain whether or not a tray 13 in a pocket 56 of the magazine 9 is filled or empty. To this end, the trays 13 are provided with indicia in the form of circular holes 67 provided in their lateral walls and allowing for visual as well as automatic determination of the presence or absence of cigarettes in the trays. As can be seen in FIG. 8, the openings 67 in the lateral walls of filled trays VS show layers of parallel cigarettes therein.

The detectors 64, 66 of the monitoring means 12 are connected with the control circuit 68 by conductor means 12a which transmit signals to the corresponding input of a processor 82 which is connected with two memories 69 and 83 of the control circuit. The memory 69 stores information pertaining to occupancy of the magazine 9; such information is in the form of a matrix which can denote the number of trays 13 at each of the two levels of the magazine, the number of empty and filled trays at each level, the locations of filled and empty trays at each level, and the location of empty pockets 56 at each level. The outputs of the control circuit 68 are connected with the motors 23 and 27 of the transferring device 8 so that the latter can move the holder 29 to a desired level and to a desired angular position for advancement of an empty or filled tray into the holder 29 or for advancement of a filled or empty tray from the holder 29 to the magazine 9 or to one of the intersections 16, 17. A further input of the control circuit 68 is connected with a position monitoring or indicating device 74 which denotes the position of the magazine 9 on a branch 11a (i.e., the position of the magazine with reference to the transferring device 8) by transmitting signals which denote the angular position of the output element of the motor 59 which drives the chain conveyor 57 for the magazine 9. The device 74 can constitute any commercially available angular position monitoring and indicating instrument. The control circuit 68 continuously updates the information which is stored in the memory 69 so that the matrix in the memory 69 is indicative of the latest distribution and number of filled (VS) and empty (LS) trays and empty pockets 56 in the magazine 9.

Additional monitoring means 71a, 71b, 72a, 72b, 73a and 73b are adjacent the facilities 4a, 4b of the tray filling unit 2 and serve to transmit signals by way of the conductors (shown but not referenced in FIG. 9) to the corresponding inputs of the control circuit 68 to update the information pertaining to the extent of occupancy of facilities 4a and 4b with empty and filled trays 13, respectively. Such information is also stored in the memory 69, the same as the information which is supplied by monitoring means 76a, 76b, 77a, 77b, 78a, 78b adjacent the facilities 6a, 6bof the tray evacuating unit 3. Thus, the information which is stored in the memory 69 is indicative of the number and distribution of filled and empty trays 13 and of empty pockets 56 in the magazine 9, of the distribution and number of empty and filled trays 13 in the facilities 4a, 4b of the unit 2, and of the distribution and number of empty and filled trays 13 in the facilities 6a, 6b of the unit 3.

The memory 83 stores a program which is relied upon by the control circuit 68 to ensure that the transferring device 8 is operated in a manner and in a sequence which is best suited to ensure an optimum distribution of filled and empty trays in the units 2, 3 and in the magazine 9. Signals which are obtained by addressing the memory 83 are used to start or arrest the motors 23, 27 and 59, i.e., to move the holder 29 to a selected angular position and/or to a selected level as well as to move the magazine 9 by way of the chain conveyor 57 in order to place an empty pocket 56, a pocket 56 which contains an empty tray LS or a pocket 56 which contains a filled tray VS next to (i.e., into the range of) the transferring device 8.

The program which is stored in the memory 83 is preferably selected in such a way that, when the output of the maker M matches or rather closely approximates the requirements of the processing machine P (i.e., when the transporting unit 1 advances the entire output of the machine M into the inlet of the machine P), the facilities 4a and 6b are half filled with empty trays and the facilities 4b and 6b are half filled with filled trays. It is now assumed that such conditions prevail, i.e., that all or nearly all of the cigarettes which issue from the maker M are delivered directly to the processing machine P and that the facilities 4a, 4b and 6a, 6bof the units 2, 3 are half filled with trays 13.

If the requirements of the processing machine P decrease, the surplus of cigarettes which are turned out by the maker M is taken over by the tray filling unit 2 which introduces the surplus into successive empty trays 13 descending from the level of the facility 4a for empty trays to the level of the facility 4b for filled trays in a manner well known from the art of HCF tray filling units. Filled trays 13 accumulate on the conveyors 14 in the facility 4b and are advanced stepwise or continuously toward the intersection 16. When the detector 71b at the level of the facility 4b transmits a signal which denotes that the conveyors 14 in the facility 4b are fully or nearly fully occupied, the control circuit 68 activates the transferring device 8 so that the holder 29 is moved to the solid-line position of FIG. 2 in which it is ready to receive the nearest filled tray 13 from the facility 4b of the facility 4b onto the holder 29 and, if there is still room in the facility 6a of the tray evacuating unit 3, the signals from the control circuit 68 cause the holder 29 to rise from the level of the facility 4b to the level of the facility 6a and to change its orientation so as to be ready to allow for advancement of the filled tray 13 onto the conveyors 18 of the facility 6a. This involves an angular displacement of the column 26 and holder 29 through 180°. The extent of occupancy of the conveyors 18 in the facility 6a is indicated by signals from the detector 78a at that end of the facility 6a which is adjacent the intersection 17.

The filling of trays 13 with cigarettes in the tray filling unit 2 enables the facility 4a of the unit 2 to accept empty trays 13 from the transferring device 8. Thus, the control circuit 68 then causes the holder 29 to descend from the level of the upper facility 6a to the level of the lower facility 6b (as soon as the filled tray 13 has been deposited on the conveyors 18 of the facility 6a), and the nearest empty tray 13 is then advanced from the conveyors 18 of the facility 6b onto the holder 29 which is thereupon turned through 180° and is lifted to the level of the facility 4a prior to advancement of the empty tray onto the conveyors 14 of the facility 4a.

The same procedure (i.e., a transfer of filled trays 13 from the facility 4b to the facility 6a and a transfer of empty trays from the facility 6b to the facility 4a) is repeated (in response to signals from the control circuit 68) until the facility 4a is filled with empty trays and/or the facility 6a is filled with filled trays. Filling of the facility 6a with filled trays 13 causes the detector 78a to transmit a signal to the control circuit 68 which thereupon causes the holder 29 to continue to accept filled trays 13 from the facility 4b but to turn only through 90° preparatory to advancement of such filled tray or trays into empty pockets 56 of the magazine 9. The corresponding position of the holder 29 is shown in FIG. 2 by phantom lines. The holder 29 can be moved to the level of the upper or lower storey of the magazine 9, and the latter is moved along the branch 11a (the motor 59 for the chain conveyor 57 receives signals from the control circuit 68 which, in turn, reads the information in the memory 69 which is indicative of the number and positions of empty pockets 56 in the magazine 9). The detector or detectors (64, 66) which monitor the occupancy of the pockets 56 transmit signals to the processor 82 to update the information in the memory 69 so that the control circuit 68 can continue to locate empty pockets 56 for transfer thereinto of filled trays 13 which are received from the facility 4b of the tray filling unit 2.

If the supply of empty trays 13 in the facility 6b of the tray evacuating unit 3 is exhausted, the detector 78b transmits an appropriate signal to the control circuit 68 which begins to initiate movements of the magazine 9 through the medium of the motor 59 in such a way that the magazine moves a pocket 56 containing an empty tray 13 next to the transferring device 8 so that the latter can advance empty trays from the pockets 56 into the facility 4a of the tray filling unit 2. To this end, the holder 29 must turn through angles of 90° and may but need not always have to move from the level of the facility 4a to the level of the lower storey of the magazine 9 and back (this depends on the positions of empty trays 13 in the magazine 9).

If the output of the maker M does not suffice to satisfy the requirements of the processing machine P, the unit 3 is set in operation to evacuate the contents of successive filled trays 13 in the facility 6a into the path which is defined by the transporting unit 1. The thus obtained empty trays 13 are deposited on the conveyors 18 in the facility 6b. If the supply of filed trays 13 in the facility 6b is depleted to a certain minimum value, the detector 76a which is adjacent the path of movement of filled trays 13 on the conveyors 18 in the facility 6a transmits a signal to the control circuit 68. The control circuit 68 then initiates the transfer of filled trays 13 from the facility 4b of the tray filling unit 2 directly onto the conveyors 18 in the facility 6a (provided, of course, that the facility 4b contains one or more filled trays). If the supply of filled trays 13 in the facility 4b is exhausted, (this is indicated by a signal from the detector 73a ), the control circuit 68 begins to start the motor 59 for the chain conveyor 57 and causes the transferring device 8 to advance filled trays from the pockets 56 of the magazine 9 onto the conveyors 18 in the facility 6a of the tray evacuating unit 3. The magazine 9 is moved along the branch 11a, and the holder 29 is moved up and down (if necessary) in response to signals which are obtained by addressing the memory 69 wherein the information pertaining to the distribution of filled and empty trays and empty pockets 56 is continuously updated in the aforedescribed manner. The holder 29 must turn through angles of 90° (in a counterclockwise direction, as seen in FIG. 2) in order to move filled trays from the magazine 9 into the facility 6a of the tray evacuating unit 3.

When the maker M is again in a condition to satisfy the requirements of the processing machine P, the control circuit 68 operates the transferring device 8 with a view to reestablish the normal conditions, i.e., to ensure that the facilities 4a, 6b are half filled with empty trays 13 and that the facilities 4b, 6a are half filled with filled trays (this is indicated by the detectors 72a, 72b and 77a, 77b, respectively). In other words, the transferring device 8 is then operated to transfer filled and/or empty trays between the units 2, 3 and/or to transfer filled and/or empty trays between the units 2 or 3 and the magazine 9 until the control circuit 68 ascertains that the occupancy of the facilities 4a, 4b and 6a, 6b is as provided for by the program in the memory 83 for operation while the requirements of the processing machine P are at least substantially met by the maker M.

Figure 10:
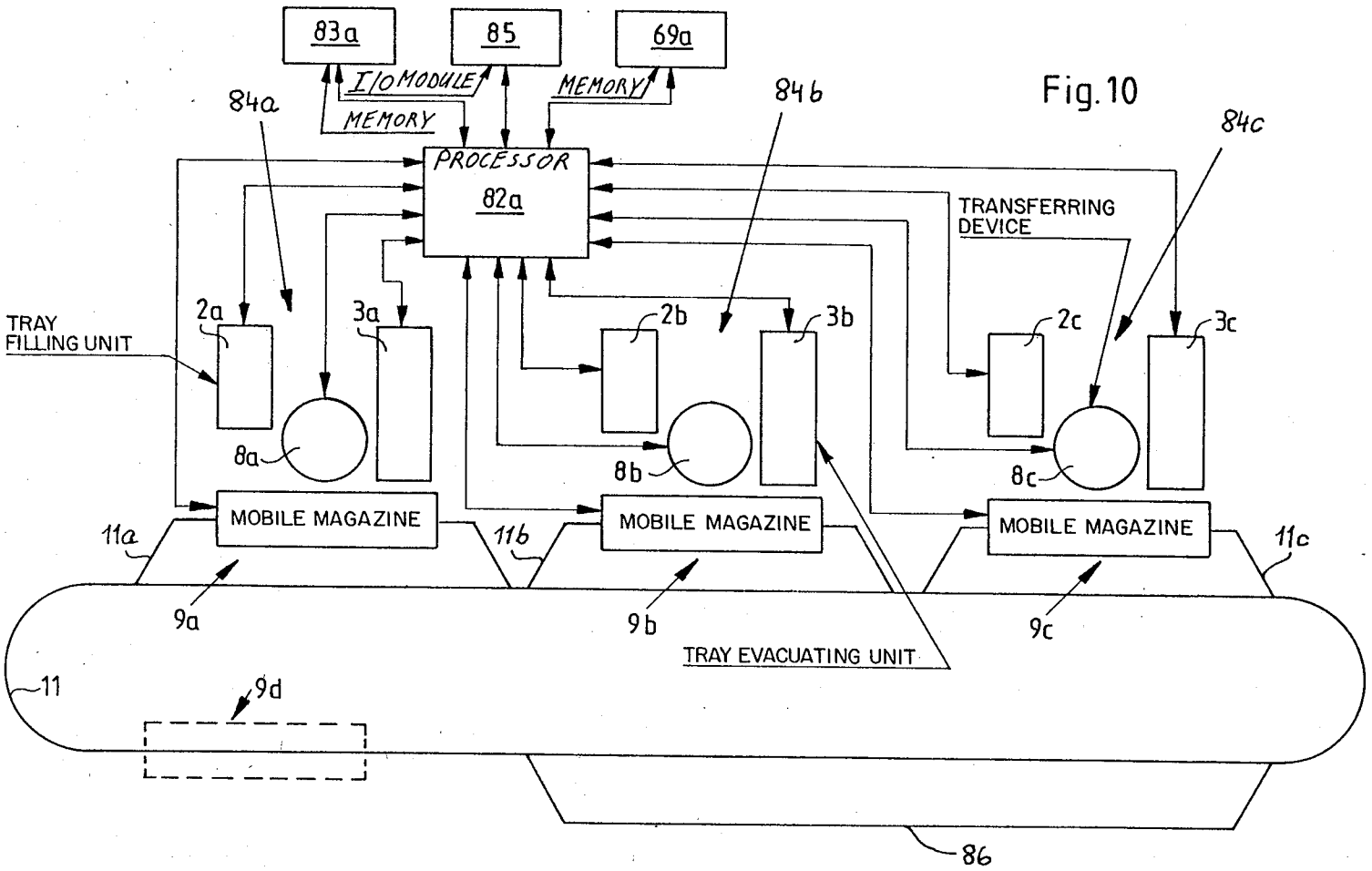
FIG. 10 is a schematic plan view of a modified apparatus with three production lines and a common control circuit for all production lines.

In order to compensate for differences between the outputs of two or more production lines each of which includes at least one tray filling unit 2 and at least one tray evacuating unit 3, the apparatus can be designed in a manner as shown in FIG. 10 for three discrete production lines 84a, 84b, 84c which respectively comprise tray filling units 2a, 2b, 2c and tray evacuating units 3a, 3b, 3c. The transporting units and the makers and processing machines are omitted in FIG. 10 for the sake of clarity. The conveyor system 11 has three branches 11a, 11b, 11c, one for each of the respective transferring devices 8a, 8b, 8c. FIG. 10 merely shows four mobile magazines 9a', 9b, 9c, 9d but it will be appreciated that the number of magazines can exceed four. Moreover, the conveyor system 11 can include a depot 86 with one or more tracks for storage of empty, partially filled or completely filled spare magazines. The magazines 9a', 9b, 9c are respectively located at the loading stations which are defined by the branches 11a, 11b, 11c of the conveyor system 11.

The construction of the units 2a–2c, 3a–3c, transferring devices 8a–8c and magazines 9a'–9d can be the same as described above with reference to FIGS. 1 to 9. The makers, the processing machines and the monitoring means of all three production 84a–84c are connected with a common control circuit having a processor 82a and a memory 69a corresponding to the memory 69 of FIG. 9 but being capable of storing information pertaining to the occupancy of all six units 2a–2c, 3a–3c and all magazines 9a'–9d. The outputs of the control circuit including the processor 82a transmit signals which automatically regulate the operation of all three transferring devices 8a–8c and the movements of all magazines along the path which is defined by the conveyor system 11. The control circuit further comprises a second memory 83a which stores a program corresponding to that which is stored in the memory of FIG. 9 except that it enables the control circuit to optimize the distribution of filled and empty trays in the tray storing facilities of all three production lines and in all of the magazines on the conveyor system 11. An input/output module (I/O module) 85 serves for introduction of data and commands as well as to facilitate central monitoring of the entire conveyor system.

The additional or spare magazine or magazines (including the magazine 9d which is indicated by broken lines) can circulate along the path which is defined by the conveyor system 11 so as to be more readily available to one or more transferring devices 8a–8c, or they may be stored in the depot 86. The conveyor system 11 can comprise two or more depots for temporary storage of empty, partially filled or completely filled magazines.

The magazines 9a'–9d are preferably provided with encoded or other information 79 (see FIG. 8) which can be decoded by a reader 81 on the post 63 at each of the loading stations. The readers 81 transmit signals to the memory 69a of the control circuit for the production lines 84a–84c of FIG. 10 in order to make sure that the memory 69a will contain updated information pertaining to the occupancy of all magazines which are or which can be circulated by the conveyor system 11. It is clear that the readers 81 need not necessarily be installed in or on the posts 63 for the monitoring means 12.

The provision of indicia (encoded information) 79 and readers 81 further enhances the versatility of the control circuit and of the entire apparatus. Thus, the control circuit can immediately select that magazine or those magazines whose occupancy is best suited for transfer of empty and/or filled trays at the loading station of the production line 84a, 84b and/or 84c.

Each of the detectors which are used in the monitoring means of the improved apparatus can constitute an optoelectronic detector, an electromechanical sensor or any other detector which can carry out the assigned task of ascertaining the number of filled and empty trays in the storing facilities of the tray filling and evacuating units and in the magazine or magazines as well as the number and the positions of empty pockets 56 in the magazine or magazines.

An important advantage of the improved apparatus is that its capacity can be increased practically at will by the simple expedient of utilizing a sufficiently large magazine 9, a sufficiently large number of discrete magazines and/or a sufficiently large number of gondolas or other types of containers for empty and filled trays. This renders it possible to satisfy the requirements of the processing machine P for long intervals of time after the maker M is turned off or turns out cigarettes at less than the normal rate, or to allow the maker M to turn out articles at the normal rate long after the processing machine P is brought to a halt or begins to consume or process articles at less than normal rate.

Another important advantage of the improved apparatus is that the locations (levels) of the facilities for filled and empty trays can be selected with a view to simplify the design and to optimize the operation of the tray filling and tray evacuating units because the transferring device or devices can take care of the transport of filled and empty trays between different levels without affecting the distribution of articles in the filled trays and with little loss in time. Upwardly or downward movements of the holder 29 can take place while the column 26 is caused to change its angular position so that the change in level of the holder 29 can be completed simultaneously with a change in angular position. This allows for a considerable reduction of the length of intervals which elapse during advancement of filled or empty trays between the associated tray filling and evacuating units and/or between such units and the magazine or magazines.

A further important advantage of the improved apparatus is that it can employ several available units and subassemblies which have been tested and actually used for many years and have been found to be highly satisfactory. This includes the mass flow transporting unit 1 between the maker M and the processing machine P, many types of makers and processing machines and many types of tray filling and evacuating units.

The transferring device 8 is highly versatile and occupies little room. This also holds true for the mechanism 31 which is used to advance empty or filled trays 11 between the holder 29 and the facilities 4a, 4b, 6a, 6b as well as between the holder 29 and the magazine 9 and/or gondolas 61. The inclination of the holder 29 with reference to the column 26 of the transferring device 8 can be readily selected in such a way that the distribution of cigarettes in a filled tray 13 which is confined in the holder does not change while the holder is caused to move up or down and/or about the vertical axis of the turntable 22. Moreover, the inclined holder 29 ensures that the cigarettes in the trays 13 on the carriage 28 are treated gently and do not lose tobacco particles at their exposed ends.

While it is also possible to employ a stationary magazine and a transferring device which is movable along the magazine, the utilization of a transferring device which is more or less permanently installed adjacent the intersections 16 and 17 is preferred at this time because the utilization of one or more mobile magazines (including wagons 9 and gondolas 61) renders it possible to increase the capacity of the apparatus practically at will. It is not necessary that the gondolas 61 be mounted for movement on an overhead conveyor; it is equally within the purview of the invention to employ a conveyor 62 which advances gondolas at the level of the facilities 4a, 6a or 4b , 6b if the gondolas 61 are used in lieu of one or more wheel-mounted wagons or like conveyances. Moreover, and even if the apparatus employs wheel-mounted conveyances, the conveyor 62 can constitute an overhead conveyor only in the region where a gondola 61 is to receive filled or empty trays from a transferring device 8 or where the transferring device is to receive trays from gondolas. Gondolas are preferred in plants where the floor space is at a premium or where it is simpler and more convenient to transport or temporarily store spare filled or empty trays at a level above the maker or makers and the processing machine or machines.

The conveyor system 11 of FIGS. 10, in conjunction with several production lines, renders it possible to balance the capacities of two or more production lines in a relatively small area and by utilizing a single control circuit. Moreover, the apparatus of FIG. 10 renders it possible to maintain the maker or makers M or the processing machine or machines P of one or more production lines in operation even if the companion machine (i.e., the processing machine or the maker) is out of commission or must be arrested for another reason) for a very long interval of time.

The exact details of the processor or processors and/or memories and/or monitoring means which are used in the improved apparatus form no part of the invention. All that counts is to ensure that, if necessary, the distribution of filled and empty trays among the tray storing facilities of the tray filling and evacuating units as well as in one or more magazines (be it wheel-mounted carriages or gondolas) can be carried out in an optimum way, with little loss in time and by subjecting the articles in the trays to a gentle treatment. As mentioned above, the operation of the apparatus can be automated to any desired extent; full automation simply involves adequate monitoring of the tray storing facilities, of the position of the holder 29 in each transferring device and of the trays in the magazine or magazines and/or gondolas.

Transporting units which can advance cigarettes or like rod-shaped articles in the form of a mass flow are disclosed in commonly owned U.S. Pats. No. 4,364,462 and 4,507,040.

The producing machines (makers) can be replaced with reservoirs of the type known als RESY which are produced and distributed by the assignee of the present application.

The processor 82 with memories 69, 83 and the processor 82a with memories 69a, 83a can constitute modules of the type known as Sucos PS 316 and PS 32 manufactured by Klöckner Möller, German Federal Republic. The I/O module 85 can be of the type known as EBE 200/250/253, also manufactured by Klöckner Möller.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating receptacles for rod-shaped articles of the tobacco processing industry, particularly for manipulating chargers for cigarettes, comprising at least one first unit for filling the receptacles; at least one second unit for evacuating articles from filled receptacles, each of said units respectively having first and second facilities for temporary storage of empty and filled receptacles; at least one magazine for temporary storage of at least one receptacle; and means for transferring receptacles between said units as well as between said magazine and at least one of said units, including a support, a carriage mounted on said support for movement between a plurality of different levels and for angular movement between a plurality of different positions with reference to a substantially vertical axis, means for moving said carriage, a holder for receptacles on said carriage, and means located on said carriage for advancing receptacles between said holder on the one hand and said facilities and said magazine on the other hand.

2. The apparatus of claim 1, further comprising at least one transporting unit having means for conveying articles along a predetermined path wherein the articles advance substantially at right angles to their axes, said first unit having means for withdrawing articles from said path and for storing the withdrawn articles in empty receptacles, said second unit having means for evacuating the contents of filled receptacles into said path.

3. The apparatus of claim 2, wherein said path has a receiving end and a discharge end, and further comprising an articles producing machine connected with said receiving end and an article processing machine connected with said discharge end.

4. The apparatus of claim 1, wherein said positions include at least one first position in which said holder can exchange receptacles with at least one of said facilities, at least one second position in which said holder can exchange receptacles with at least one other facility, and at least one third position in which said holder can exchange receptacles with said magazine.

5. The apparatus of claim 1, wherein said advancing means comprises a first lever having a first position pivotable about a fixed axis with reference to said support and a second portion, a second lever having a first portion articulately connected with the second portion of said first lever and a second portion provided with means for entraining receptacles, means for pivoting said first lever with reference to said support, and means for moving said second lever with reference to said first lever in response to pivoting of said first lever so that said entraining means performs a movement along a substantially straight path.

6. The apparatus of claim 5, wherein said holder includes a bottom wall having an upperside and said straight path is substantially parallel to the upper side of said bottom wall.

7. The apparatus of claim 1, wherein said holder includes means for supporting receptacles in an inclined position.

8. The apparatus of claim 7, further comprising means for changing the inclination of receptacles preparatory to or during transfer between said holder and said facilities.

9. The apparatus of claim 1, wherein said magazine is a mobile magazine.

10. The apparatus of claim 9, wherein said magazine is a floor-mounted conveyance and further comprising means defining a predetermined path for said conveyance.

11. The apparatus of claim 9, further comprising an overhead conveyor system for said mobile magazine.

12. The apparatus of claim 11, wherein said magazine includes a gondola.

13. The apparatus of claim 1, further comprising at least one additional first and second unit and an additional means for transferring receptacles between said additional first and second units and said magazine, said magazine including a mobile magazine and further comprising means for conveying the mobile magazine along a predetermined path having portions adjacent said transferring means.

14. Apparatus for manipulating receptacles for rod-shaped articles for the tobacco processing industry, particularly for manipulating chargers for cigarettes, comprising at least one first unit for filling of the receptacles; at least one second unit for evacuating articles from filled receptacles, each of said units respectively having first and second facilities for temporary storage of empty and filled receptacles; at least one magazine for temporary storage of at least one receptacle; means for transferring receptacles between said units as well as between said magazine and at least one of said units; and control means for regulating the operation of said transferring means so as to ensure the presence and the status of receptacles in the respective facility of said first unit and the presence and the status of receptacles in the respective facility of said second unit.

15. The apparatus of claim 14, wherein said control means comprises a processor, a data storing memory connected with said processor, and a program memory connected with said processor.

16. The apparatus of claim 14 for manipulating receptacles of the type having means for facilitating discrimination between filled and empty receptacles, further comprising signal generating means for monitoring the presence of receptacles in the magazine, signal generating means for monitoring the discrimination facilitating means of receptacles in the magazine, and means for transmitting signals from said monitoring means to said control means.

17. The apparatus of claim 14, further comprising signal generating detector means for monitoring the extent to which the facilities of said units are occupied by filled and empty receptacles and means for transmitting signals from said detector means to said control means.

18. The apparatus of claim 17, wherein said control means comprises a memory for said signals and processor means for updating the information in said memory on the basis of signals from said detector means.

19. The apparatus of claim 14, wherein said control means includes a memory for a predetermined program and means for addressing said memory so as to operate said transferring means in accordance with said program.

20. The apparatus of claim 14, comprising a plurality of magazines each having identifying indicia, and further signal generating reader means arranged to read said indicia and to transmit signals to said control means.

21. Apparatus for manipulating receptacles for rod-shaped articles of the tobacco processing industry, particularly for manipulating chargers for cigarettes, the receptacles being of the type having means for facilitating discrimination between filled and empty receptacles, comprising at least one first unit for filling of the receptacles; at least one second unit for evacuating articles from filled receptacles, each of said units respectively having first and second facilities for temporary storage of empty and filled receptacles; at least one magazine for temporary storage of at least one receptacle; means for transferring receptacles between said units as well as between said magazine and at least one of said units; control means for regulating the operation of said transferring means so as to ensure the presence of empty receptacles in the respective facility of said first unit and the presence of filled receptacles in the respective facility of said second unit; signal generating means for monitoring the presence of receptacles in the magazine; signal generating means for monitoring the discrimination facilitating means of receptacles in the magazine; and means for transmitting signals from said monitoring means to said control means, said control means including means for storing said signals in the form of a matrix and means for operating said transferring means in dependency on the information which is stored in said matrix.

22. The apparatus of claim 21, wherein said magazine is a mobile magazine and further comprising means for moving said magazine in response to signals from said control means.

23. Apparatus for manipulating receptacles for rod-shaped articles of the tobacco processing industry, particularly for manipulating chargers for cigarettes, comprising at least one first unit for filling of the receptacles; at least one second unit for evacuating articles from filled receptacles, each of said units respectively having first and second facilities for temporary storage of empty and filled receptacles; at least one mobile magazine including a gondola having means for temporary storage of at least one receptacle; an overhead conveyor system for said mobile magazine; and means for transferring receptacles between said units as well as between said magazine and at least one of said units, including a support, a carriage mounted on said support for movements between a plurality of different levels and for angular movement between a plurality of different positions with reference to a substantially vertical axis, means for moving said carriage, and a holder for receptacles on said carriage, said positions including at least one position in which said holder is located at or close to the level of the gondola on said overhead conveyor system.

24. Apparatus for manipulating receptacles for rod-shaped articles of the tobacco processing industry, particularly for manipulating chargers for cigarettes, comprising at least one first unit for filling of the receptacles; at least one second unit for evacuating articles from filled receptacles, each of said units respectively having first and second facilities for temporary storage of empty and filled receptacles; a plurality of magazines for temporary storage of receptacles, each of said magazines having identifying indicia; means for transferring receptacles between said units as well as between said magazines and at least one of said units; control means for regulating the operation of said transferring means so as to ensure the presence of empty receptacles in the respective facility of said first unit and the presence of filled receptacles in the respective facility of said second unit; signal generating reader means arranged to read the indicia of said magazine and to transmit signals to said control means; at least one additional first and second unit; and additional transferring means for said additional first and second units, said control means including means for associating each of said magazines with a selected transferring means on the basis of signals received from said reader means.

25. Apparatus for manipulating receptacles for rod-shaped articles of the tobacco processing industry, particularly for manipulating chargers for cigarettes, comprising at least one first unit for filling of the receptacles; at least one second unit for evacuating articles from filled receptacles, each of said units respectively having first and second facilities for temporary storage of empty and filled receptacles; at least one magazine for temporary storage of at least one receptacle; means for transferring receptacles between said units as well as between said magazine and at least one of said units; at least one additional first and second unit; additional transferring means for said additional units; at least one additional magazine; common control means for regulating the operation of all of said transferring means so as to ensure the presence and the status of receptacles in the respective facilities of said first units and the presence and the status of receptacles in the respective facilities of said second units; signal generating means for monitoring the occupancy of facilities in said first and second units and of said magazines; and means for transmitting signals from said monitoring means to said control means, said control means including a memory for signals from said monitoring means and processor means for operating said transferring means in response to addressing of said memory.

* * * * *